United States Patent [19]

Matsumoto et al.

[11] Patent Number: 4,728,266

[45] Date of Patent: Mar. 1, 1988

[54] MOTOR DRIVE VACUUM PUMP

[75] Inventors: Akio Matsumoto, Hyogo; Kimiaki Seki, Kasai, both of Japan

[73] Assignee: Mitsubishi Denki Kabushiki Kaisha, Tokyo, Japan

[21] Appl. No.: 22,522

[22] Filed: Mar. 9, 1987

Related U.S. Application Data

[63] Continuation-in-part of Ser. No. 906,617, Sep. 10, 1986, abandoned, which is a continuation of Ser. No. 535,328, Sep. 23, 1983, abandoned.

[30] Foreign Application Priority Data

Oct. 9, 1982 [JP] Japan ..... 57-153901[U]
Oct. 9, 1982 [JP] Japan ..... 57-153902[U]

[51] Int. Cl.[4] ..... F04B 17/00; F04B 35/00

[52] U.S. Cl. ..... 417/366; 417/423 A; 181/202

[58] Field of Search ..... 417/366, 372, 423 A, 417/369; 181/202, 225, 236, 237, 254

[56] References Cited

U.S. PATENT DOCUMENTS

| | | | |
|---|---|---|---|
| 1,476,776 | 12/1923 | Stamm et al. | 417/350 |
| 2,091,537 | 8/1937 | Wahlborg | 417/366 |
| 2,155,669 | 4/1939 | Lofgren | 417/423 A |
| 2,214,193 | 9/1940 | Cowles | 417/423 A |
| 2,422,860 | 6/1947 | Seyfried | 417/423 A |
| 2,531,342 | 11/1950 | Metz | 417/366 |
| 2,570,222 | 10/1951 | Ell | 417/423 A |
| 2,658,665 | 11/1953 | Tschudy | 417/366 |
| 2,888,192 | 5/1959 | Cole et al. | 417/371 |
| 3,199,774 | 8/1965 | Lowell | 417/366 |
| 3,704,078 | 11/1972 | Conery et al. | 417/369 |
| 3,987,775 | 10/1976 | O'Connor | 417/478 |
| 3,993,416 | 11/1976 | Kato | 417/366 |
| 4,161,996 | 7/1979 | Dolejsi | 181/237 |
| 4,346,783 | 8/1982 | Scarton et al. | 181/237 |
| 4,484,659 | 11/1984 | Buchwalder | 181/237 |

FOREIGN PATENT DOCUMENTS

| | | | |
|---|---|---|---|
| 48114 | 4/1977 | Japan | 417/312 |

*Primary Examiner*—Carlton R. Croyle
*Assistant Examiner*—Donald E. Stout
*Attorney, Agent, or Firm*—Oblon, Fisher, Spivak, McClelland & Maier

[57] ABSTRACT

A motor drive vacuum pump comprises a motor provided with a rotor, a stator and a housing holding the rotor and the stator therein, a vacuum pump which is attached on the side surface of the motor housing and is driven by the motor to forcibly feed air from an intake port to a discharge port to thereby generate vacuum, a discharging passage means comprising a discharging hole for introducing the air to be discharged through the discharge port of the vacuum pump into the motor interior and a through hole formed in a part of the housing to discharge the air introduced into the motor interior to the atmosphere, and a discharge valve provided in a part of the discharging passage means.

6 Claims, 7 Drawing Figures

FIGURE 4 a
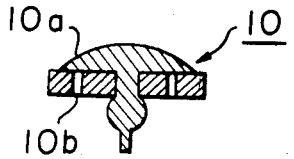
FIGURE 4 b
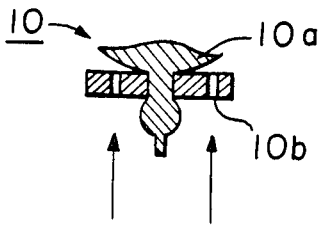
FIGURE 4 c
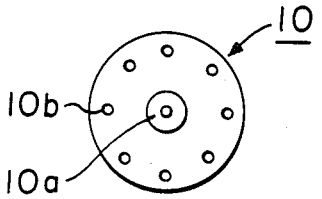
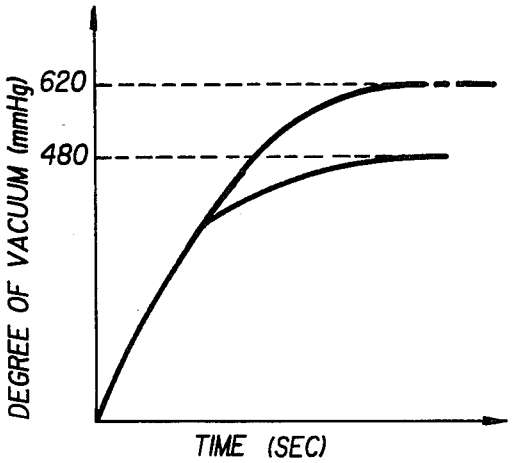
FIG. 5

MOTOR DRIVE VACUUM PUMP

This application is a Continuation-in-Part of application Ser. No. 906,617, filed on Sept. 10, 1986, now abandoned, which is a Continuation of application Ser. No. 535,328, filed Sept. 23, 1983, now abandoned.

The present invention relates to a motor drive vacuum pump. More particularly, it relates to a motor drive vacuum pump having an improved discharging passage.

BACKGROUND OF THE INVENTION

As this kind of the motor drive vacuum pump, there has been known one as shown in FIG. 1 of the accompanying drawing. In FIG. 1, the reference numeral 1 designates a motor which comprises a stator 1*a* consisting of magnetic poles each of which holds a field winding, a rotor 1*b* rotatably supported with respect to the stator 1*a* leaving a small air gap 1*c* therebetween, and a housing 1*d* holding the stator 1*a* and the rotor 1*b* therein. A vacuum pump 3 is attached to the motor 1 and is driven by a motor shaft 2. The references 4 and 5 respectively designate an intake port and a discharge port connected to the vacuum pump 3. The intake port 4 is connected to the vacuum tank 6. The reference 7 designates a check valve connected between the intake port 4 and the vacuum tank 6. The numeral 8 designates a drain hole formed in the housing 1*d* of the motor 1.

The operation of the device described above will be explained.

Actuation of the motor 1 causes revolution of the shaft 2 to drive the vacuum pump 3 with the result that air in the vacuum tank 6 is sucked through the check valve 7 and the intake port 4 and is sent pressurized to the discharge port 5 to be discharged in the atmosphere. The check 7 valve is to prevent air from reversely flowing into the vacuum tank 6 when the vacuum pump 3 is stopped, which keeps the vacuum tank 6 in an evacuated state.

In the conventional device having the construction described above, there has been a problem of noise generated from the discharge port 5. Especially, in a vane type vacuum pump which is so constructed that air sucked from the intake port 4 is compressed on the way to the discharge port 5 before discharged, the compressed air causes a great noise when it is discharged from the discharge port 5. Further, when vacuum (mmHg) in the vacuum tank 6 increases and there is a small amount of air to be sucked, there disadvantageously occurs noise due to sliding movement of the vanes.

OBJECTS OF THE INVENTION

It is an object of the present invention to provide a motor drive vacuum pump suppressing generation of noise from a discharge port and being reliable in operation by connecting the discharge port of a vacuum pump to the motor interior to discharge air from the vacuum pump to the atmosphere through the motor interior via a drain hole wherein a discharge valve is provided in a part of a discharging passage.

It is another object of the present invention to provide a motor drive vacuum pump capable of deadening noise in an economical manner by connecting a discharge port of a vacuum pump to the motor interior and by discharging air through a discharge valve which serves as a drain hole of the motor.

It is still another object of the present invention to provide a motor drive vacuum pump capable of deadening noise and incrasing the quality of a motor by introducing air from a vacuum pump into the motor interior through a discharge valve and discharging the air to the atmosphere through a drain hole of the motor.

SUMMARY OF THE INVENTION

The foregoing and the other objects of the present invention have been attained by providing a motor drive vacuum pump comprising a motor provided with a rotor, a stator and a housing holding the rotor and the stator therein; a vacuum pump which is attached on the side surface of the motor housing and is driven by the motor to forcibly feed air from an intake port to a discharge port to thereby generate vacuum; a discharging passage means comprising a discharging hole for introducing the air to be discharged through the discharge port of the vacuum pump into the motor interior and a through hole formed in a part of the housing to discharge the air introduced into the motor interior to the atmosphere; and a discharge valve provided in a part of the discharging passage means.

BRIEF DESCRIPTION OF THE DRAWINGS

The foregoing objects, and as well as specific construction and operations of the motor drive vacuum pump according to the present invention will become apparent and understandable from the following detailed description thereof when read in conjunction with the accompanying drawings, in which:

FIG. 4*a* and 4*b* are respectively cross sectional views in the closing and opening states of a discharge valve and FIG. 4*c* is a bottom view of the discharge valve used in the motor drive vacuum pump of the present invention; and FIG. 5 is a diagram illustrating comparative tests of the efficiency of the embodiment shown in FIG. 3 with and without the umbrella type discharge valve 10*a* in place.

DETAILED DESCRIPTION OF THE PRESENTLY PREFERRED EMBODIMENTS

Figure 1:
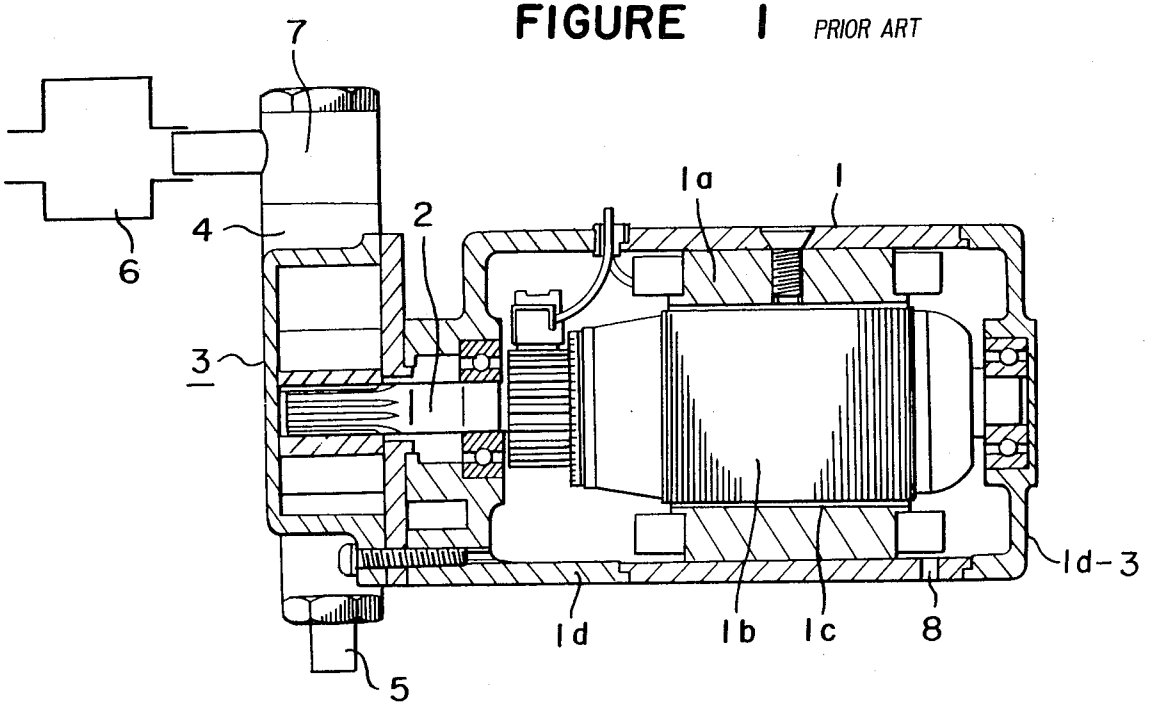
FIGURE 1 PRIOR ART
FIG. 1 is a side view, partly in cross-section, of a conventional motor drive vacuum pump.

Preferred embodiments of the present invention will be described with reference to FIGS. 2–4. The same reference numerals designate the same or corresponding parts.

Figure 2:
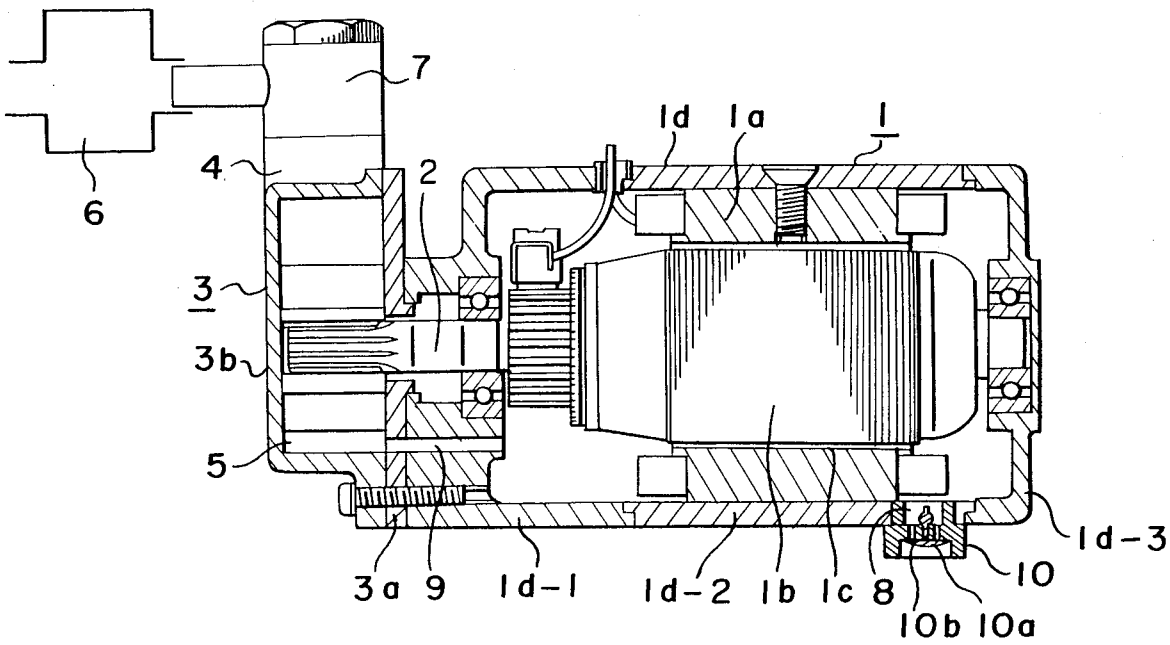
FIG. 2 is a side view, partly in cross-section, of an embodiment of the motor drive vacuum pump of the present invention.

FIG. 2 shows a first embodiment of the present invention in which a motor 1 comprises a stator 1*a* composed of magnetic poles on which field windings are wound, a rotor 1*b* rotatably supported leaving a small air gap 1*c* between the outer peripheral surface of the rotor and the inner peripheral surface of the stator, and a housing 1*d* for holding the stator 1*a* and the rotor 1*b* therein. The housing 1*d* composed of a front bracket 1*d*-1 and a rear bracket 1*d*-3 which rotatably support the rotor 1*b* and a frame 1*d*-2 for supporting the stator 1*a*. The front and rear brackets 1*d*-1 and 1*d*-3 are of a closed type without any opening communicating the motor interior with the atmosphere. A drain hole 8 is formed in the frame 1*d*-2 to drain water. A vacuum pump 3 is attached to the motor 1 and is driven by a rotary shaft 2.

The rotary shaft 2 of the motor 1 extends into the pump chamber of the vacuum pump 3. The vacuum pump 3 is provided with a side plate 3*a* attached to the front bracket 1*d*-1 of the motor 1 and a casing 3*b* defining the pump chamber. The vacuum pump 3 is a well known vane type vacuum pump comprising a rotor fixed to the rotor shaft 2 which extends into the pump chamber in an eccentric manner and a plurality of vanes which are held in the rotor so as to be radially extendable and are in slide-contact with the inner peripheral portion of the pump chamber. The vacuum pump 3 is provided with an intake port 4 and a discharge port 5, and the intake port 4 is connected to a vacuum tank 6 through a check valve 7.

The reference numeral 9 designates a discharging hole perforated through the side plate 3*a* and the front bracket 1*d*-1 to communicate the discharge chamber of the vacuum pump 3 with the motor interior, and the numeral 10 designates a discharge valve fitted to the drain hole 8 to drain water condensed in the motor 1. The discharge valve 10 (shown in FIG. 4) comprises an umbrella type valve 10*a* made of a flexible material and having a plurality of air vent holes 10*b* opened and closed by the umbrella type valve 10*a*. The discharging hole 9, the drain hole 8, and the inner space of the motor 1 constitute a discharging passage means.

In the construction described above, when the motor 1 is actuated, air in the vacuum tank 6 is sucked through the intake port 4; is fed through the discharge port 5 of the vacuum pump 5 via the discharging hole 9 into the inner space of the motor 1; is then passed through the air gap 1*c* and a small space formed by the umbrella type valve 10*a* and the air vent holes 10*b* of the discharge valve 10; and is finally discharged to the atmosphere. Thus, the construction that air from the vacuum pump 3 is introduced into the motor interior before it is discharged suppresses variation of pressure, and noise generated from the discharge port can be minimized. Further, the suppressing of noise is further increased by passing air through small spaces between the vent holes 10*b* and the umbrella type valve 10*a*.

Water condensed or entering in the motor interior is discharged with the air through the discharge valve 10, which also serves as a drain hole.

Figure 3:
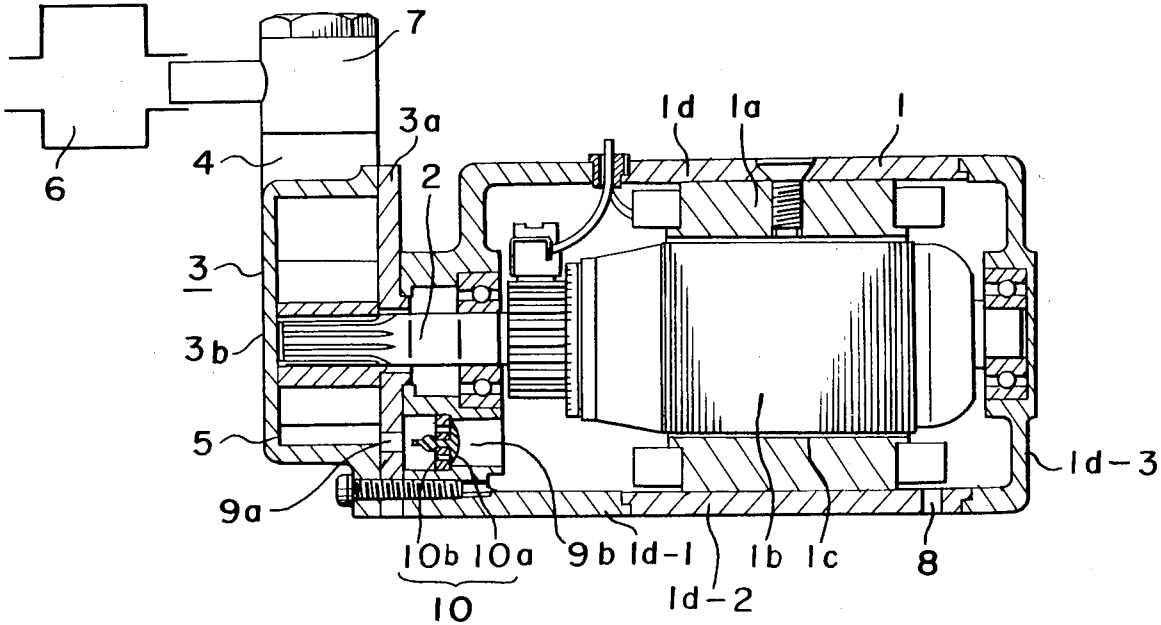
FIG. 3 is a side view similar to FIG. 2 of another embodiment of the present invention.

FIG. 3 shows another embodiment of the present invention. The same reference numerals designate the same parts. In FIG. 3, the reference numeral 9*a* designates a first discharging hole perforated through the side plate 3*a* of the vacuum pump 3, and the numeral 9*b* designates a second discharging hole perforated through the front bracket 1*d*-1 so as to be communicated with the first discharging hole 9*a*. The second discharging hole 9*b* has a cross-sectional area larger than that of the first discharging hole 9*a*. The numeral 10 designates a discharge valve provided in the second discharging hole 9*b* and composed of an umbrella type valve 10*a* and a plurality of air vent holes 10*b*.

In the second embodiment having the construction described above, when the motor 1 is actuated, air in the vacuum tank 6 is sucked through the intake port 4, and is passed through the first discharging hole 9*a*,—the air gap formed by the umbrella type valve 10*a* and the air vent holes 10*b* provided in the second discharging hole 9*b*, and the inner space of the motor 1, and is finally discharged through the drain hole 8 to the atmosphere. The motor drive vacuum pump shown in FIG. 3 can also be minimize noise as in FIG. 2.

As described above, in accordance with the present invention constructed in such a manner that the discharge port of a vacuum pump is connected to the inner space of a motor so that air from the vacuum pump is discharged through the inner space and a drain of the motor and a discharge valve is provided at a part of the discharging passage, the following excellent effects are obtainable.

(a) Noise of the vacuum pump is reduced in an economical manner.

(b) The discharge valve increases discharge resistance, to thereby further reducing the discharge noise.

(c) Entrance of water, dust, etc. into the vacuum pump is avoided, whereby reliability of the vacuum pump increases.

(d) The cooling effect to the motor is improved and reduction in the properties of the motor is prevented because air is passed through the inner space of the motor.

FIG. 5 is a diagram illustrating comparative tests of the efficiency of the embodiment shown in FIG. 3 with and without the umbrella type discharge valve 10*a* in place. As is apparent from this diagram, the pump characteristics (i.e., the achievable degree of vacuum) were notably improved with use of the umbrella type discharge valve 10*a*. Specifically, with the umbrella type discharge valve 10*a* in place, a vacuum of 620 mm Hg was obtained, whereas without the umbrella type discharge valve 10*a* in place, a vacuum of only 480 mm mercury could be obtained. This is an improvement of 29% with the umbrella type discharge valve 10*a* in place.

When the pump of the present invention is used as a negative pressure source for a brake booster installed in a vehicle, the foregoing means that a larger braking force can be obtained with the use of a smaller foot force. This is a very significant effect both safety-wise and economically.

The present invention is also applicable to a vacuum pump not only for use with the vehicle, but also for other usage. In such cases, improvements of 20 to 30% are obtainable.

The exact degree of vacuum achievable is, of course, dependent on the parts clearances. However, the diagram shown in FIG. 5 is believed to be a fair representation of the order of magnitude improvement achievable with this invention.

We claim:

1. A motor driven vacuum pump comprising:

(a) a hollow housing having a front end and a rear end, said hollow housing having a drain hole therein near its rear end;

(b) a stator mounted on the inner periphery of said hollow housing between the front end of said housing and said drain hole, said stator being mounted in said hollow housing in a fashion which does not permit air to pass between said stator and said housing;

(c) a rotor rotatably mounted in said housing and positioned inside said stator in a fashion which leaves a small air gap between said rotor and said stator;

(d) a pump chamber having an intake port and a discharge port mounted on the front end of said housing;

(e) a rotary shaft mounted on said rotor and extending into said pump chamber in an air-tight fashion;

(f) a vacuum pump mounted on said rotary shaft and positioned in said pump chamber between said intake port and said discharge port;

(g) a first path of fluid communication connecting said discharge port in said pump chamber to the interior of said hollow housing between said front end of said hollow housing and said small air gap;

(h) said first path of fluid communication, said small air gap, and said drain hole comprising a discharging passage means; and (i) a sound deadening discharge valve mounted in said drain hole, said sound deadening discharge valve comprising an umbrella-type valve which is resiliently biased to close a plurality of air vent holes, said discharge valve being resiliently biased to close said discharging passage means but being sized and shaped so that it is opened by the passage of air through said drain hole, whereby air forced out of said pump chamber through said discharge port by rotation of said vacuum pump is forced exclusively through said small air gap and said sound deadening discharge valve, both of which function as silencers.

2. A motor driven vacuum pump as recited in claim 1 wherein:

(a) said hollow housing comprises front and rear end brackets which support said rotor and a frame which supports said stator and (b) said pump chamber comprises a cup-shaped casing and a side plate which closes said cup-shaped casing and which is attached to said front end bracket.

3. A motor driven vacuum pump as recited in claim 2 wherein said first path of fluid communication comprises communicating holes in said side plate and in said front end bracket.

4. A motor driven vacuum pump comprising:

(a) a hollow housing having a front end and a rear end, said hollow housing having a drain hole therein near its rear end;

(b) a stator mounted on the inner periphery of said hollow housing between the front end of said housing and said drain hole, said stator being mounted in said hollow housing in a fashion which does not permit air to pass between said stator and said housing;

(c) a rotor rotatably mounted in said housing and positioned inside said stator in a fashion which leaves a small air gap between said rotor and said stator;

(d) a pump chamber having an intake port and a discharge port mounted on the front end of said housing;

(e) a rotary shaft mounted on said rotor and extending into said pump chamber in an air-tight fashion;

(f) a vacuum pump mounted on said rotary shaft and positioned in said pump chamber between said intake port and said discharge port;

(g) a first path of fluid communication connecting said discharge port in said pump chamber to the interior of said hollow housing between said front end of said hollow housing and said small air gap;

(h) said first path of fluid communication, said small air gap, and said drain hole comprising a discharging passage means; and (i) a sound deadening discharge valve mounted in said first path of fluid communcation, said sound deadening discharge valve comprising an umbrella-type valve which is resiliently biased to close a plurality of air vent holes, said discharge valve being resiliently biased to close said first path of fluid communication but being sized and shaped so that it is opened by the passage of air through said first path of fluid communication, whereby air forced out of said pump chamber through said discharge port by rotation of said vacuum pump is forced exclusively through said small air gap and said sound deadening discharge valve, both of which function as silencers.

5. A motor driven vacuum pump as recited in claim 4 wherein:

(a) said hollow housing comprises front and rear end brackets which support said rotor and a frame which supports said stator and (b) said pump chamber comprises a cup-shaped casing and a side plate which closes said cup-chaped casing and which is attached to said front end bracket.

6. A motor driven vacuum pump as recited in claim 5 wherein:

(a) said first path of fluid communication comprises communicating holes in said side plate and in said front end bracket and (b) said sound deadening discharge valve is located in the hole in said front end bracket.

* * * * *